United States Patent [19]

Schwarz

[11] 3,981,332

[45] Sept. 21, 1976

[54] DEVICE FOR DRIVING A CARRIER FOR A FILLING-THREAD GRIPPER HEAD ON A LOOM

[75] Inventor: Erwin Schwarz, Ruti, Switzerland

[73] Assignee: Ruti Machinery Works Ltd., Ruti, Switzerland

[22] Filed: Mar. 10, 1975

[21] Appl. No.: 557,086

[30] Foreign Application Priority Data

Mar. 11, 1974 Switzerland ..... 3339/74

[52] U.S. Cl. ..... 139/449

[51] Int. Cl.[2] ..... D03D 47/00

[58] Field of Search ..... 139/122 R, 123, 124 R, 139/127 R, 128, 441–446, 449; 74/25, 52, 110, 764, 785, 789

[56] References Cited

UNITED STATES PATENTS

| | | | |
|---|---|---|---|
| 2,818,882 | 1/1958 | Haberhauer | 139/123 |
| 3,392,756 | 7/1968 | Golobart | 139/122 |

FOREIGN PATENTS OR APPLICATIONS

| | | | |
|---|---|---|---|
| 1,105,603 | 6/1955 | France | 139/123 |
| 1,179,254 | 1/1970 | United Kingdom | 139/122 |

*Primary Examiner*—Henry S. Jaudon
*Attorney, Agent, or Firm*—Donald D. Denton

[57] ABSTRACT

A drive device for a carrier of a filling-thread gripper head on a loom in which the carrier is moved back and forth by a drive wheel that is rotated alternately in opposite directions through a planetary gearing arrangement, the operation of the drive device being synchronized with the movement of the batten and harness of the loom.

5 Claims, 5 Drawing Figures

DEVICE FOR DRIVING A CARRIER FOR A FILLING-THREAD GRIPPER HEAD ON A LOOM

BACKGROUND OF THE INVENTION

The present invention relates to a device for driving a carrier of a filling-thread gripper head on a loom with which the carrier is movable back and forth by a drive wheel which is rotatable alternately in opposite directions.

The invention is particularly concerned with providing a drive device of the said type that will function in such a manner that it requires less space than known embodiments but nevertheless is capable of transmitting relatively large forces, thus providing an improvement in the carrier of the filling-thread gripper head.

SUMMARY OF THE INVENTION

The drive device of the invention is characterized by a planetary gearing which comprises a sun wheel or gear connected with the drive or band wheel, at least one planet wheel or gear in engagement with the sun wheel; an outer wheel, which is arranged coaxially to the sun wheel, has an inner toothing, and is in engagement with the planet wheel, as well as a planet wheel strap which rotatably bears the planet wheel. The drive device furthermore is characterized by a shaft which rotates synchronously with a batten and harness drive of the loom and is operatively connected with at least either elements of the planet wheel strap or the outer wheel by a mechanism which converts the rotary motion of the shaft into a reciprocating turning motion of the said element around the axis of the sun wheel.

This invention therefore provides a particularly compact construction of drive device in connection with which, furthermore, practically all parts of the device carry out rotating movements, which contributes to quieter operation than with those known devices in which structural parts of relatively high mass are moved back and forth linearly.

In one embodiment, it is contemplated that both the planet wheel strap and the outer wheel of the planetary gearing are each connected with the shaft via a separate gearing which converts the movement of rotation of the shaft into a reciprocating turning movement of the planet wheel strap and of the outer wheel respectively. In this connection, either the planet wheel strap or the outer wheel of the planetary gearing can be advantageously connected with the shaft via a crank mechanism while the other of said parts is connected via a can mechanism, the crank mechanism and the cam mechanism being adapted to each other in such a manner that the resultant reciprocating movements of the drive wheel take place in pulse-like manner and are separated by intervals of time during which the filling-thread gripper head is outside the shed. By suitable selection of the shape of the cam in the cam mechanism, the reciprocation of the drive or band wheel caused in this connection by the crank mechanism can be corrected as desired within wide limits in order to achieve a course of movement of the filling-thread gripper head which is favorable for the operation of the loom.

The planet wheel strap can advantageously be of annular shape and be arranged concentrically around the axis of the sun wheel, and the planet gearing can have at least two planet wheels whose axes are arranged on the planet wheel strap at equal distances from each other. In this way there are obtained favorable symmetrical distributions of the forces in all elements of the planetary gearing, which makes it possible to transmit relatively high forces.

Further details, features and advantages of the invention will be evident from the following description of the illustrative embodiment and from the accompanying drawings on the basis of which the invention will be explained.

DESCRIPTION OF PREFERRED EMBODIMENTS

Figure 1:
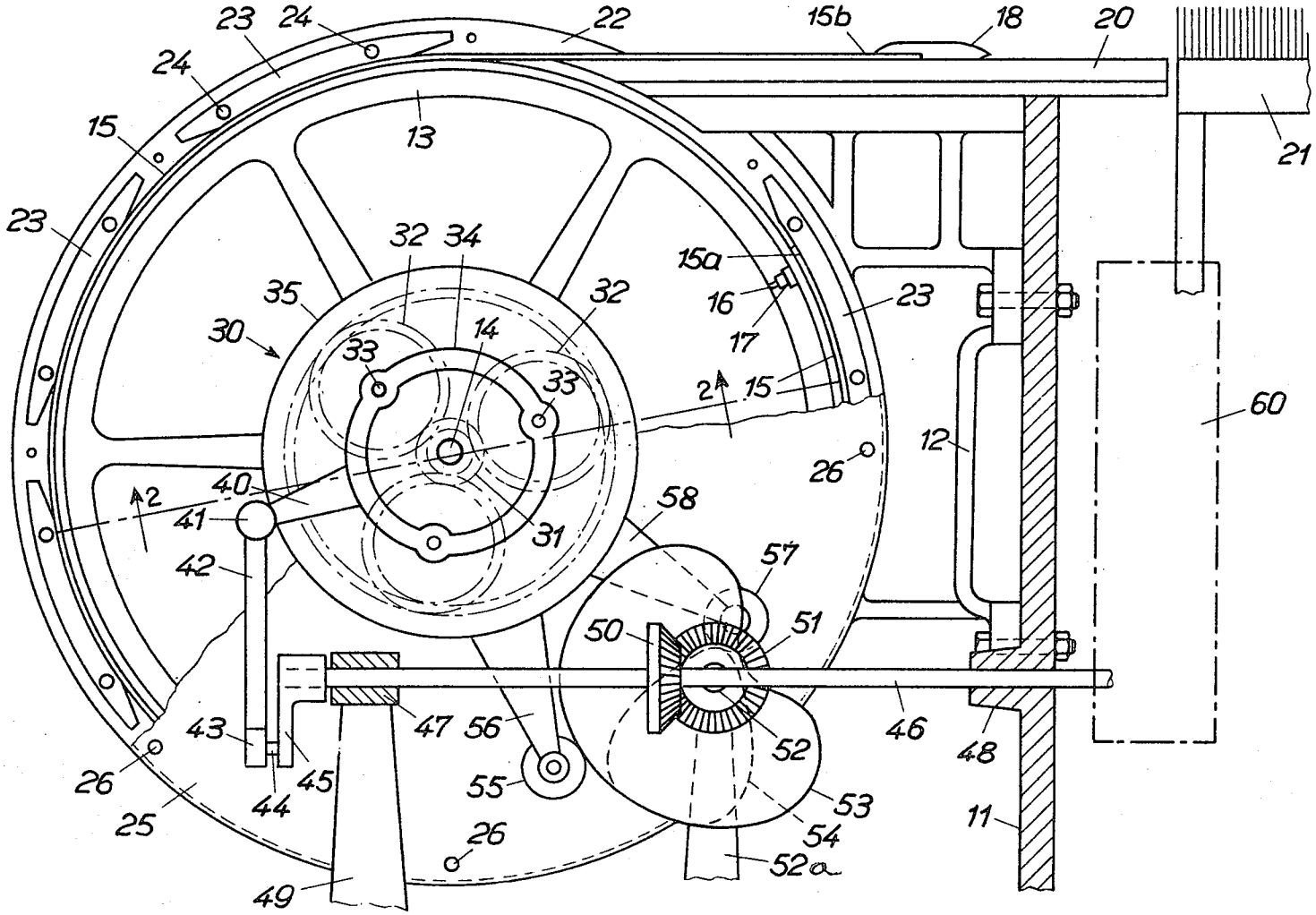
FIG. 1 shows a view that is partially in section and partially schematic with cutaway portions therein of a band wheel with a planetary gearing and a camming mechanism for alternately rotating the band wheel, only part of the loom being shown.
Figure 2:
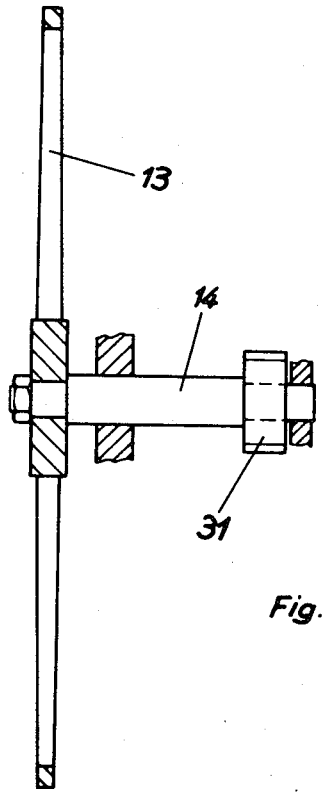
FIG. 2 is a partial sectional view taken on line 2—2 of FIG. 1, of the wheel 13 showing the connection of the band wheel 13 to the pinion for rotating the planetary gearing.
Figure 3:
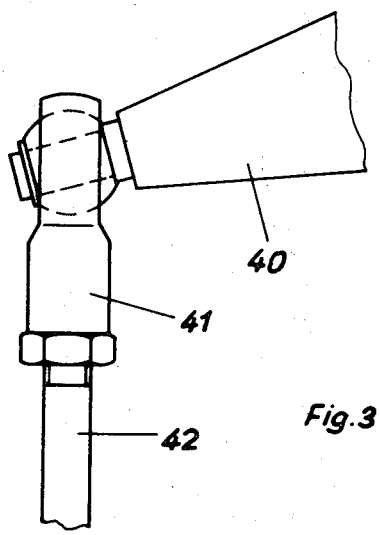
FIG. 3 is a vertical view of the ball and socket joint for shifting the planet wheel strap.
Figure 4:
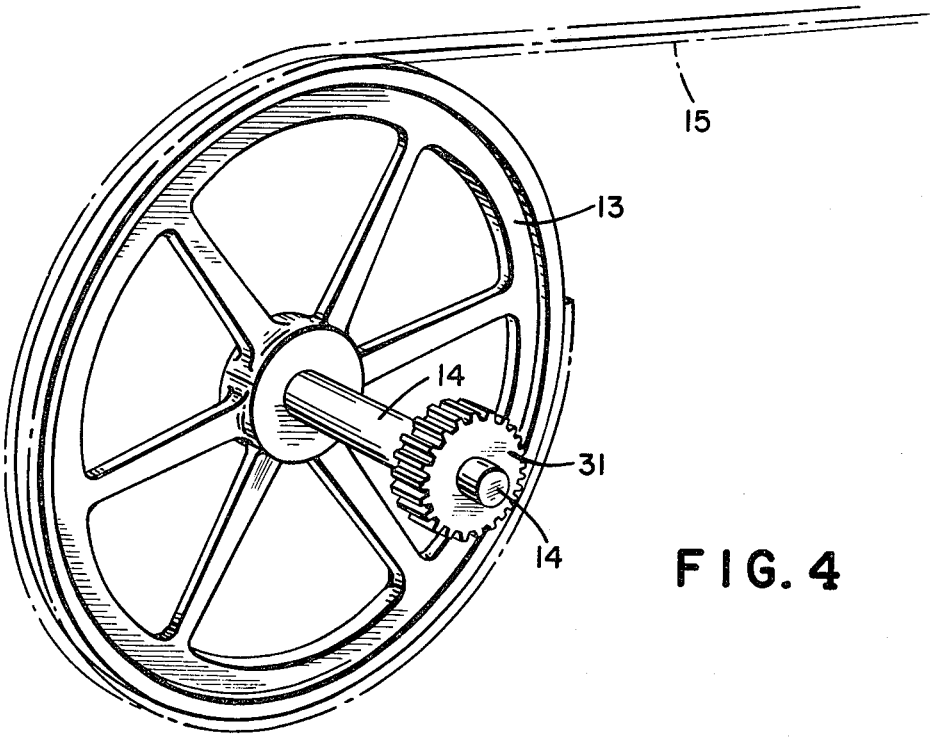
FIG. 4 is a perspective view of the section shown in FIG. 2 showing the pinion that forms the sun wheel.
Figure 5:
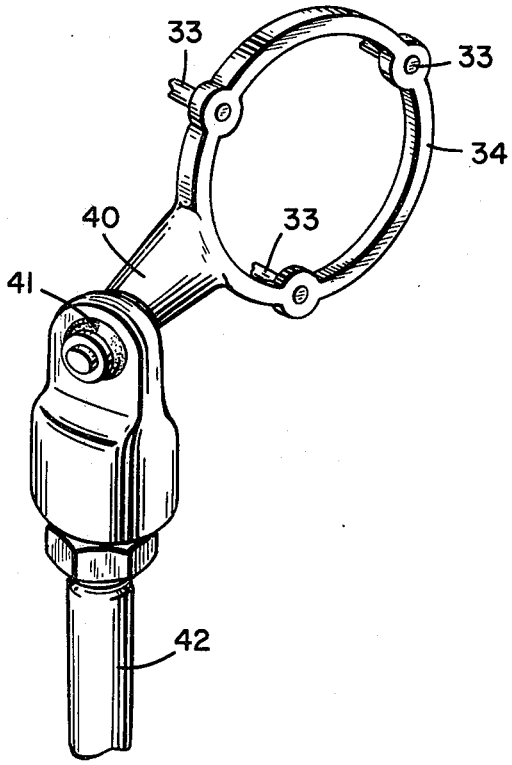
FIG. 5 is a perspective view of the ball and socket joint shown in FIG. 3 showing in detail the ball and socket joint and planet wheel strap and one end of each of the shafts which operatively connect the wheel strap to the gear wheel which engages the internal gear toothing of the outer wheel.

This invention forms a part of a loom in which each filling thread is introduced into the shed by means of a gripper head. The gripper head is arranged on one end of a flexible band, for instance of steel, whose other end is fastened to a circumferential portion of a band drive wheel. When the gripper head is pulled back out of the shed, the band is wound onto the circumference of the drive wheel; and while the gripper head is introduced into the shed, it is unwound from the drive wheel. In this connection, the gripper head is pushed into the shed by means of the band. The drive wheel is arranged on the side of the machine frame of the loom and can be driven synchronously with the batten and the harnesses. Various embodiments of looms of this type are known in the art and therefore need not be described in detail.

In the drawing, the left side wall of the machine frame of the loom is designated 11. On the outside of the side wall 11 there is fastened a carrying piece 12 on which a drive or band wheel 13 is rotatably supported by means of a shaft 14. A flexible band 15, consisting for instance of thin steel plate, is placed around the circumference of the drive wheel 13, and the one end **15*a* of this band is fastened to the drive wheel by means of a bolt 16 and a corresponding nut 17. The outer end 15*b* of the band 15 bears a gripper head 18 for the insertion of the filling thread. The gripper head 18 travels on a band guide 20, the top of which is tangential to the circumference of the drive wheel 13. The position of the drive wheel 13 and of the band guide 20 with respect to the rest of the loom is such that the batten 21 in each case forms a continuation of the band guide 20 when the batten is in its position in which it is closest to the harnesses and farthest away from the filling-thread beating-up point. The carrying piece 12** has a part 22 developed as a circular disk in the center of which the shaft 14 of the drive wheel 13 is located. The diameter of the disk-shaped part 22 is greater than that of the drive wheel 13. The edge portion of the disk-shaped part 22 which extends radially beyond the circumference of the drive wheel 13 has positioned thereon a plurality of band guide shoes 23 extending along circular arcs which are fastened to the disk-shaped part 22 by screws 24. The band guide shoes 23 serve to hold the band 15 resting against the circumference of the drive wheel 13 when the band 15 is unwound by rotation of the drive wheel 13 in clockwise direction. The band drive wheel 13 is advisedly enclosed between the disk-shaped part 22 and a housing shell 25 which is detachably fastened to the part 22 by means of screws 26. The arrangement described so far is already known.

On the shaft 14 of the drive wheel 13 there is seated and attached a pinion 31 which forms the sun wheel of a planetary gearing 30. The pinion 31 is in engagement with three gear wheels 32, all of which have the same number of teeth. The shafts 33 of the gears 32 are supported on an annularly shaped planet wheel strap 34, at equal distances apart. An outer wheel 35 with internal gear toothing is in engagement with all the planet wheels 32. Both the planet wheel strap 34 and the outer wheel 35 are coaxial to the shaft 14.

The planet wheel strap 34 has an outward protruding arm 40 which is connected by a ball and socket joint 41 with the one end of a crank connecting rod 42. The other end of the connecting rod 42 is connected by an articulation means 43 with a crank pin 44 of a crank 45 which is seated on the one end of a shaft 46. The articulation means 43 preferably has a so-called self-aligning roller bearing which makes possible not only the rotation of the crank pin 44 with respect to the connecting rod 42 but also a limited inclination of the connecting rod 42 with respect to the direction extending at right angles to the crank pin 44. The shaft 46 extends at a right angle to the axes of the drive wheel 13 and of the wheels 31, 32 and 35 of the planetary wheel gearing 30; it is rotatably supported in bearings 47 and 48 which, in the illustrative embodiment shown schematically, are arranged on a support 49 and in the side wall 11 of the loom frame respectively.

The crank mechanism as defined by numerals 40 to 45 provides for the backward and forward turning movement of the planetary wheel strap 34 from the movement of rotation of the shaft 46 which is synchronized with the functioning of the batten and harness drive. On the shaft 46 there is fastened a bevel gear 50 which is in engagement with a second mating bevel gear 51 having the same number of teeth. The second bevel gear 51 is seated on a cam shaft 52 which is arranged parallel to the shaft 14 of the drive wheel 13 and is turnably supported on a support 52*a*. The two gears 51, 52 form a bevel gear arrangement. The cam shaft 52 has attached thereto two cams 53 and 54 which may possibly consist of a single piece of material. Against the periphery or face of the one cam 53 there rests a feeler roller 55 which is arranged turnably at the free end of an arm 56 which protrudes outward from the outer wheel 35 of the planetary gearing 30. In similar manner there rests against the periphery or face of the other cam 54 a feeler roller 57 which is arranged rotatably on the free end of an arm 58 which also protrudes outward from the outer wheel 35 of the planetary gearing 30. The cam mechanism 52 to 58 described and the bevel gears 50 and 51 serve to derive a backward and turning turing movement of the outer wheel 35 of the planetary gearing 30 from the movement of rotation of the shaft 46.

The shaft 46 is coupled with the batten and harness drive mechanism 60 of the loom which is shown only schematically in the drawing, in such a manner that the continuously rotating shaft 46 travels in cyclic synchronization with the movement of the batten and the harness and thus drives the planet wheel strap by a first mechanism and the outer wheel by a second mechanism synchronously with a betten and harness drive of the loom.

The manner of operation of the drive device described for the band drive wheel 13 is as follows:

In the position of the part as shown in the drawing, the batten 21 of the loom is in the filling-thread beating-up position and the filling-thread gripper head 18 is in its position moved farthest out of the shed. Accordingly, the band 15 is wound to the maximum extent on the drive wheel 13. The crank 45 is in its lowermost position so that by means of the connecting rod 42 and the arm 40, the planet wheel strap 34 is turned farthest in counterclockwise direction. The feeler roller 55 is at the highest point on the face of the cam 53 and the feeler roller 57 is at the lowest point on the face of the cam 54 so that the outer ring 35 of the planetary gearing 30 is turned farthest in clockwise direction.

While the batten 21 moves backward from the filling thread beating-up point, the crank 45, by means of the connecting rod 42, swings the arm 40 upward as a result of which the planet wheel strap 34 is turned in clockwise direction. In order to facilitate understanding, let us first of all assume that the outer ring 35 is held immovable, which is actually approximately the case at the start since the cams 53 and 54 each have a circumferential portion extending appproximately along a circular arc in the region in question. The rotation of the planet wheel strap 34 in clockwise direction caused by the crank mechanism 40 to 45 results in the rolling of the planet wheels 32 along the inner toothing of the outer wheel 35 as a result of which the sun wheel is also driven in clockwise direction by the planet wheels. Together with the sun wheel 31, the band drive wheel 13 rotates as a result of which the band 15 is unwound from the circumference of the drive wheel 13 and is pushed to the right as seen in the drawing, together with the filling-thread gripper head 18 on the guide rail 20.

On this movement of the drive wheel 13 caused by the crank mechanism or cranking means 40 to 45, there is superimposed a movement caused by the cam mechanism or camming means 52 to 58. The cam shaft 52 is driven via the bevel gears 50 and 51 with the same circumferential speed as the shaft 46. When the batten 21 moves towards its position farthest away from the filling-thread beating-up point, the cam 54 pushes the arm 58 upward by means of the feeler roller 57, whereby the outer wheel 35 of the planetary gearing 30 is turned in counterclockwise direction. The other cam 53 is so shaped that it permits an identical swinging motion of the arm 56. The said rotation of the outer wheel 35 in counterclockwise direction causes an additional turning of the planet wheels 32 around their axes 33 in the same direction as a result of which the sun wheel 31 and the band drive wheel 13 which is connected with it are driven in clockwise direction. This rotation of the sun wheel 31 and of the driven wheel 13 adds on to the turning movement caused by the crank mechanism 40 to 45, i.e. the band drive wheel 13 is turned through a correspondingly larger angle. As a result, the gripper head 18 is pushed with relatively high speed into the open shed while the batten 21 is located approximately at its rear dead center remote from the beating-up point. The gripper head drags a filling thread into the shed and transfers the thread to the second gripper head inserted from the opposite side.

After the crank 45 has passed through its uppermost position, the arm 40 of the planet wheel strap 34 is swung downward by the connecting rod 42 and the planet wheel strap is thereby turned in counterclockwise direction. This results in a rearward turning of the sun wheel 31 and of the band drive wheel 13 in the same direction. At the same time, by means of the feeler roller 55, the cam 53 forces the arm 56 of the outer wheel 35 downward, whereby the outer wheel turns in clockwise direction and a turning of the sun wheel 31 and of the drive wheel 13 in counterclockwise direction is also caused. In this way the band 15 is wound onto the circumference of the drive wheel 13 and the gripper head 18 is pulled out of the shed. Since the movement drives of the crank mechanism 40 to 45 and of the cam mechanism 52 to 58 are superimposed on each other, the result is a rapid movement of the gripper head 18 until it is outside the shed. The movements of the band drive wheel 13 and of the gripper head 18 then slow down when the crank mechanism 40 to 45 and the cam mechanism 52 to 58 assume their initial position, shown in the drawing. As soon as the gripper head 18 is outside the shed, the batten 21 carries out the beating-up movement for beating-up the filling thread previously introduced into the shed against the cloth already produced.

Thereupon the processes described repeat themselves periodically.

As can be noted from the drawing, the cams 53 and 54 are so shaped that they effect a special course of movement of the band drive wheel 13 and of the filling thread gripper head 18. The movements of the drive wheel 13 and of the gripper head 18 which result from the superimposing of the movement drives of the crank mechanism 40 to 45 on the one hand and the cam mechanism 52 to 58 on the other hand are advisedly of such a nature that the gripper head 18 in each case rapidly enters the opened shed and after the transfer of the filling thread to a second gripper or thread clamp also rapidly emerges again from the shed as long as the batten 21 is near to or at the rear dead center, and the movement of the gripper head 18 is considerably slowed down when the gripper head is outside the shed and the beating up of the inserted filling thread by means of the batten 21 takes place. The rapid forward and return movements of the gripper head 18 within the shed are thus followed by an interval of long duration during which the gripper head 18 is outside the shed.

It is clear that the variation of movement with time of the band drive wheel 13 and of the gripper head 18 can be established as desired within wide limits by suitable shaping of the cams 53 and 54. Thus it is possible to make the movement of the gripper head 18 faster upon its emergence from the shed than upon its entrance into the shed. Similarly the result can be obtained that the gripper head after emergence from the shed remains approximately at rest until the filling thread inserted has been beaten up and the batten is again close to its rear dead center. This is of particular advantage in the case of a clamping gripper since in this way there is a relatively large amount of time available to transfer the thread to the clamp.

It will be appreciated that the crank mechanism 40 to 45 for the backward and forward driving in rotation of the planet wheel strap 34 could be replaced by a second cam mechanism whereby an even greater freedom in the selection of the course of the movement of the band drive wheel 13 and of the filling thread gripper head 18 is obtained.

Although it is probably advantageous as a rule, as in the case of the embodiment described, to impart to both the planet wheel strap 34 and the outer wheel 35 of the planetary gearing 30 a separate backward and forward turning movement, it is nevertheless also possible either to drive only the planet wheel strap 34 or only the outer wheel 35, in which case there is advisedly used a cam mechanism in order to convert the continuous rotating movement of the shaft 46 into the desired backward and forward turning movement of the planet wheel strap 34 or of the outer wheel 35.

Instead of the crank mechanism 40 to 45 and the cam mechanism 52 to 58 which have been described and shown, any other suitable mechanisms can of course also be used which convert the rotary movement of the shaft 46 into a backward and forward turning motion.

The driving device described and the said variant embodiments thereof have a number of advantages over known devices, the most important of which are the following: All structural parts, with the exception of the connecting rod 42, carry out only turning movements so that the necessity of the guidiing of linearly reciprocating parts with plane bearings is dispensed guiding Since most parts are only turned and not moved in translation, a relatively quiet vibration-free movement results. The use of a planetary gearing permits a compact construction of the drive device, and relatively large forces can be transmitted with only a small amount of space taken up. The resultant course of movement of the band drive wheel and of the filling-thread gripper head can be adapted as desired within wide limits to the requirements of the weaving operation.

It will be appreciated that various changes and modifications may be made within the skill of the art without departing from the spirit and scope of the invention illustrated and described herein.

What is claimed is:

1. Drive device for a carrier of a filling-thread gripper head on a loom in which the carrier can be moved back and forth by a drive wheel which is turnable alternatively in opposite directions, with a planetary gearing arrangement comprising a sun wheel rigidly connected with the drive wheel, at least one planet wheel in engagement with the sun wheel, an outer wheel having an inner toothing which is arranged coaxial to the sun wheel and which is also in engagement with said planet wheel, a planet wheel strap which rotatably supports the said planet wheel, a drive shaft which drives the planet wheel strap by a first mechanism and the outer wheel by a second mechanism synchronously with a batten and harness drive of the loom in order to convert the movement of rotation of said drive shaft into a back and forth turning movement of said planet wheel strap and of said outer wheel around the axis of said sun wheel.

2. Drive device according to claim 1 in which one of the elements comprising the planet wheel strap and the outer wheel is operatively connected to the shaft by a crank mechanism and the other of the said elements is connected to said shaft by a cam mechanism, said crank mechanism and cam mechanism are so adapted to operate in relation to each other that the resultant forward and backward movements of the drive wheel take place in pulse-like manner and are separated by intervals during which the filling-thread gripper head is outside the shed.

3. Drive device according to claim 2 in which the planet wheel strap is connected by the crank mechanism to the shaft and the outer wheel is connected by the cam mechanism to the shaft.

4. Drive device according to claim 2 in which the shaft extends at right angle to the axes of rotation of the drive wheel and of the wheels forming the planet gearing and has attached at one end thereof a crank which is coupled by means of a crank connecting shaft with an arm attached to the planet wheel strap, and the said shaft is further connected by a bevel gear arrangement with a cam shaft which is parallel to the axes of the drive wheel and of the wheels of the planet arrangement on which cam shaft there is seated at least one cam with which an arm attached to the outer wheel of the planet gearing cooperates.

5. Drive device according to claim 1 in which the planet wheel strap is of ring shape and is arranged concentrically around the axis of the sun wheel, and said planetary gearing arrangement comprises at least two planet wheels whose axes are arranged at equal distances from each other on the planet wheel strap.

* * * * *